United States Patent [19]

Pearce et al.

[11] 4,452,373

[45] Jun. 5, 1984

[54] JEWELRY BOX HINGE STRUCTURE

[75] Inventors: Don J. Pearce, Smithfield; Richard J. Pearce, Lincoln, both of R.I.

[73] Assignee: Packaging By Forming Industries, Inc., Smithfield, R.I.

[21] Appl. No.: 388,643

[22] Filed: Jun. 15, 1982

[51] Int. Cl.[3] ..... B65D 43/24

[52] U.S. Cl. ..... 220/335; 220/4 E; 220/337; 220/338; 206/566

[58] Field of Search ..... 220/4 E, 334, 335, 337, 220/338, 342; 206/566; 190/49, 54

[56] References Cited

U.S. PATENT DOCUMENTS

| | | | |
|---|---|---|---|
| D. 162,284 | 3/1951 | Braun et al. . | |
| D. 208,113 | 7/1967 | Shiffman . | |
| D. 259,398 | 6/1981 | Shiffman . | |
| 1,026,081 | 5/1912 | Dorais . | |
| 1,833,305 | 11/1931 | Rathbun . | |
| 2,319,346 | 5/1943 | Rathbun . | |
| 2,433,483 | 12/1947 | Root, Jr. . | |
| 3,233,820 | 2/1966 | Williams . | |
| 3,337,086 | 8/1967 | Jenks . | |
| 3,352,520 | 11/1967 | Bumgarner et al. . | |
| 3,355,088 | 11/1967 | Young . | |
| 3,416,655 | 12/1968 | Shiffman . | |
| 3,477,091 | 11/1969 | Gordon | 220/334 |
| 3,606,072 | 9/1971 | Pinchin . | |

FOREIGN PATENT DOCUMENTS

| | | |
|---|---|---|
| 390233 | 4/1933 | United Kingdom . |
| 1120973 | 7/1968 | United Kingdom . |

*Primary Examiner*—George T. Hall

*Attorney, Agent, or Firm*—Lane, Aitken & Kananen

[57] ABSTRACT

A jewelry box includes a pair of identical mating frames having interengaging protrusions to define an integral hinge. A shell is secured to each frame to define a body member and a cover member for the box. A variety of shells having different depths, colors and surface finishes are produced for a given size frame, and a variety of combinations of shells can be selected for each box.

10 Claims, 6 Drawing Figures

JEWELRY BOX HINGE STRUCTURE

BACKGROUND OF THE INVENTION

In the field of containers, such as jewelry boxes, for holding and displaying merchandise, it is advantageous that the container be easily openable and closable, that it operate reliably and yet be inexpensive to produce. In addition, it is desirable that a producer be able to produce containers of various sizes capable of exhibiting a variety of appearances.

Jewelry boxes have been produced which comprise a body and a cover hinged together with a biasing device such as a tempered metal spring clip connected at the hinge to move the body and the cover together in a snap action, while allowing the box to remain open in a fully open position. For example, jewelry boxes have been made from cardboard comprising a body member and a cover member, a metal hinge secured to the members and a spring clip attached to the metal hinge to bias the members toward one another around the hinge. A felt or other decorative covering is used to hide the cardboard and present a pleasant appearance. Other jewelry boxes have been made with body and cover members of metal, with a separate, attached hinge, a spring clip and a decorative covering, as are used with the cardboard boxes. Still other jewelry boxes have been made from plastic body and cover members, each of which has small projections which engage and cooperate with the projections of the other member to define a hinge when the members are held together and biased closed by a spring clip or other biasing device secured to the members. The outer surfaces of the plastic members can be formed with a dull finish or a shiny finish, they can be embossed with a pattern to simulate leather or other material, or a flocking material like felt can be sprayed or otherwise applied to the members.

Each of the prior art boxes described above has a number of drawbacks. For some, a separate hinge must be attached, which adds to the cost of producing the box. In addition, for at least those boxes which provide a hinge defined by projections on the body and cover members, the body and cover members differ, thus requiring the manufacturing of two different types of members for each box produced. Therefore, two different dies or molds, each of which represents a major capital expenditure, are required to produce each size and style of box. Furthermore, the members of the prior art boxes are limited to a predetermined capacity, and so varying the capacity requires the production of entirely different members by still other dies or molds.

SUMMARY OF THE INVENTION

Accordingly, it is an object of the present invention to provide a box made of body and cover members which include identical mating frames, thereby eliminating the need for dies, molds or other production equipment to produce two types of members rather than one.

It is a further object of the present invention to provide a box and method of producing it which permits great flexibility with respect to the size, color and surface finish of the body member and the cover member.

Toward the fulfillment of these and other objects, the box according to the present invention comprises a pair of identical frames, each frame having projections which are complementary to the projections of another identical frame when it is inverted and placed on the first frame, whereby the projections mate with one another to define an integral hinge. The frames are held together by a tempered metal spring clip which engages an anchoring lug defined on each frame adjacent to the projections to bias the frames together in pivotal snap action around the hinge. Each frame has an internal ledge which receives an outwardly directed peripheral flange of a tray-shaped shell to define each body member and cover member and further includes detents above the ledge for helping to retain the shell in place. The shells can be inexpensively thermoformed and their flanges bonded to the internal ledges of the frames by sonic welding or other suitable means. Shells having various depths can be received in a frame of a given size. In addition, the color and surface texture of the shell can be varied as desired and need not be the same as that of the shell in the mating frame.

The method of producing such a box eliminates the need for producing a cover member having a different configuration from its mating body member and the corresponding cost of two dies or molds to produce a box of just one size and style. It also eliminates the need for producing an entirely different member for each variance in member depth, color or surface texture.

DETAILED DESCRIPTION OF THE PREFERRED EMBODIMENT

Figure 1:
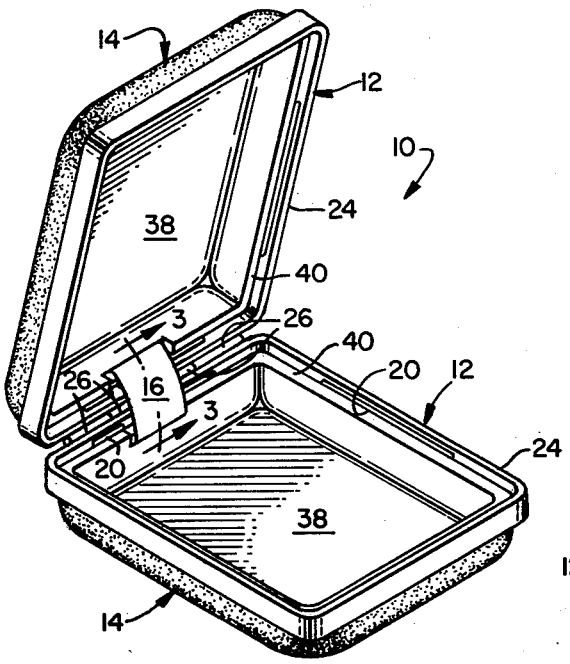
FIG. 1 is a perspective view of the box according to the present invention in its fully opened position.

As is illustrated in FIG. 1, a box generally designated by the reference numeral 10 and especially well suited for the storage and display of jewelry and other merchandise is shown in the fully opened position. The box includes a pair of identical frames 12 which can be made of injection molded plastic. Each frame 12 receives a shell 14 which can be made of a thermoformed material, such as plastic, the shell 14 being attached to the frame 12 by bonding, such as that resulting from sonic welding, to define the body member and the cover member of the box 10. The shells 12 can be identical to one another, or one shell can be deeper than the other, or have a different color or surface texture. The frames 12 are held together by a spring clip 16 of tempered metal in a manner which will be described in connection with the other drawing figures.

Figure 3:
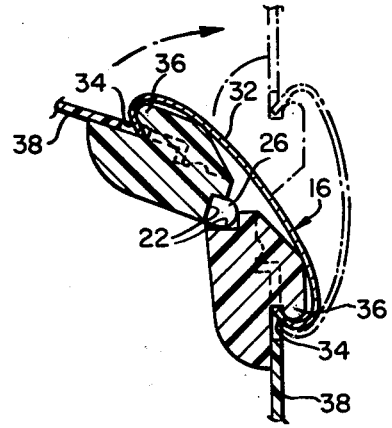
FIG. 3 is a cross section taken along the line 3—3 in FIG. 1.
Figure 4:
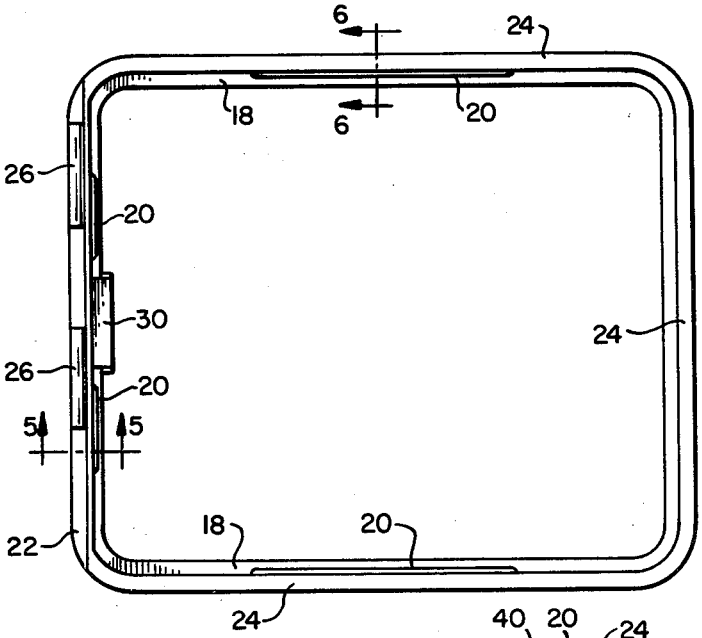
FIG. 4 is a plan view of the lower frame of FIG. 2.

The frames 12 may be of a wide variety of shapes, although the configuration illustrated is generally rectangular. As can clearly be seen from FIGS. 1, 2 and 4, frame 12 includes an internal ledge 18 around most of its inner periphery. Spaced slightly above the ledge 18 are a plurality of retaining lugs 20 for helping to retain the shells in a manner to be described hereinafter. One portion of the frame 12 includes a shoulder 22 spaced slightly below a rim 24 of the frame 12 toward which the ledge 18 faces and a pair of protrusions 26 extending upward from the shoulder 20 beyond the rim 24 of the frame 12 by a distance slightly greater than the distance between the shoulder 22 and the rim 24 of the frame 12. When the other identical frame 12 of the pair is inverted and placed on top of the first frame 12 so that the rims 24 engage, the protrusions 26 of the inverted frame 12 interengage the protrusions 26 of the first frame 12 to define a hinge integral with the frames. One protrusion 26 of each frame 12 is positioned immediately adjacent the longitudinal center of the hinge, and the other protrusion 26 is across the longitudinal center from the first protrusion 26, spaced by a distance substantially equal to the length of one of the protrusions 26. The protrusion 26 on the inverted frame 12 adjacent the longitudinal center of the hinge is received within the space between the protrusions 26 of the first frame 12, and the protrusion 26 on the first frame adjacent the longitudinal center of the hinge is received between the protrusions 26 of the inverted frame 12. The protrusions of each frame 12 also engage the portion of the other frame 12 extending between the shoulder 22 and the rim 24, as can best be seen in FIG. 3.

The tempered metal spring clip 16 engages an anchoring lug 30 defined on the inner periphery of each frame 12, on the side of the frame containing the protrusions 26. Each spring clip 16 includes a curved body portion 32 and a flange 34 at each end of the body portion 32 which are angled toward one another on the concave side of the body portion 32. Each flange 34 engages a lobe 36 which is defined on the anchoring lug 30 and extends from the anchoring lug in a direction away from the rim 24. As is evident from FIGS. 3 and 5, the lobe 36 is spaced from the inner periphery of the frame 12, and one of the flanges 34 on the spring clip 16 engages the lobe 36 and protrudes into the space between the lobe 36 and the frame 12.

The engagement of the flanges 34 of the spring clip 16 with the lobes 30 of the frames 12 holds the frames securely together so that the protrusions 26 of each frame 12 are interengaged with the protrusions 26 of the other frame 12 of the pair, and engaged with the portion of the other frame extending between the shoulder 22 and the rim 24. The protrusions 26 are rounded so that the frames 12 may be pivoted easily about the protrusions. As the frames 12 are pivoted away from one another, the lobes 36 separate and, thus, stretch the spring clip 16 so that the curve in the body portion 32 of the spring clip 16 is straightened. When the frames 12 are separated to the point where the box 10 is fully opened, the spring clip 16 acts to maintain the box 10 in the opened position due to the fact that the force of the spring clip 16 at this point acts over the pivotal center of the hinge, away from the body 32 of the spring clip 16, due to the relative positions of the lobes 30 when the box 10 is fully opened. The lobe configuration and the size of the spring clip 16 are chosen so that the fully opened position of the box 10 is one in which the frames 12 are held apart at an angle slightly less than 90°. It is understood, however, that the box 10 can be designed to be maintained in a fully open position with the frames 12 forming an angle of 90° or more. When the frames 12 are forced out of their fully opened position by a slight amount, the force of the spring clip 16 acts against the lobes 30 on the side of the pivotal center of the hinge where the body 32 of the spring clip 16 is positioned. Thus, from this point on, the spring clip 16 biases the box 10 closed in a snap action.

Figure 2:
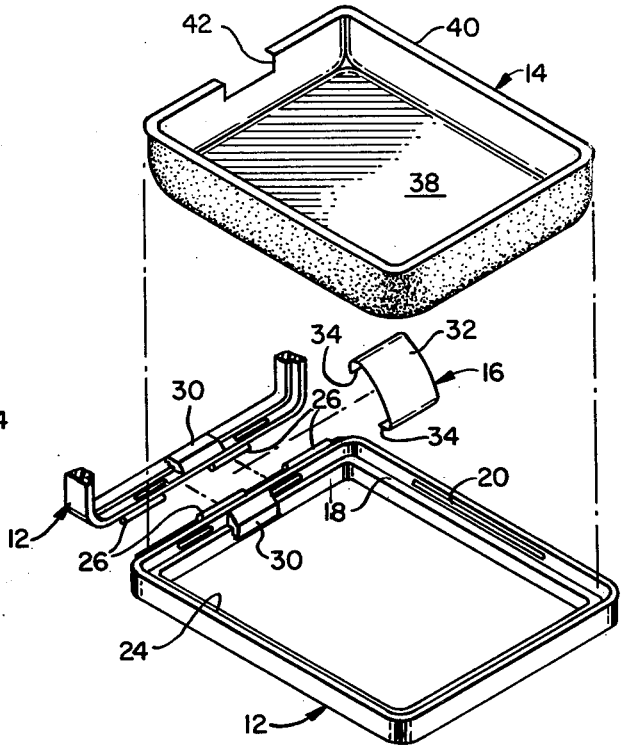
FIG. 2 is an exploded perspective view of the lower frame of the box of FIG. 1 and a portion of the upper frame.
Figure 5:
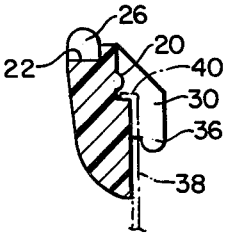
FIG. 5 is a cross section taken along the line 5—5 in FIG. 4.
Figure 6:
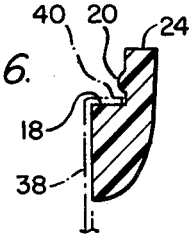
FIG. 6 is a cross section taken along the line 6—6 in FIG. 4.

Most of the area of the body member and the cover member of the box 10 is defined by the shells 14. Each shell 14 comprises a body portion 38 having a configuration complementary to the configuration of the frame 12 with which the shell 14 is to be used. As is illustrated in FIGS. 2, 5 and 6, the body portion 38 includes an outwardly directed flange 40 which is received on the ledge 18 defined on the inner periphery of the frame 12. The flange 40 is secured to the ledge 18 by sonic welding, adhesive, or other suitable means. In addition, the retaining lugs 20 extend over the edge of the flange 40 to aid in retaining the shell 14 in position in the frame 12 both during assembly and afterwards. In addition, a notch 42 is defined in the shell 14 adjacent to the anchoring lug 30 to accommodate the anchoring lug and the spring clip 16. The shells 14 may have various depths for a given peripheral dimension, and thus for a given frame 12, and may be made in a variety of colors and with a variety of surface textures and treatments.

In producing the box 10 according to the present invention, only one plastic mold or die is required to produce both frames 12 for the box. In addition, the hinge for the box 10 is defined by protrusions 26 integral with the frames 12 and only a separate spring clip 16 must be added. Furthermore, identical shells 14 may be attached to each of the frames 12 of a pair, or shells of various depths, colors and surface finishes can be applied to a given pair of frames in a wide number of combinations. Among the surface finishes contemplated are smooth finishes, dull finishes, embossments, and coatings of flocking material like felt.

Although it is apparent from the foregoing that the present invention provides significant advantages in the construction of boxes, it is understood that the various changes and modifications may be made without departing from the spirit and scope of the present invention as recited in the appended claims and their legal equivalents.

What is claimed is:

1. A container for storing and displaying merchandise comprising:

a pair of identical frames;

a shell secured to each frame to define a body member and a cover member for the container;

protrusions on each frame which cooperate with the protrusions on the other frame to define a hinge; and means for holding the protrusions together.

2. The container of claim 1 wherein each frame comprises a first protrusion adjacent the longitudinal center of the hinge and a second protrusion positioned across the longitudinal center of the hinge from the first protrusion and spaced from the first protrusion a distance substantially equal to the length of the first protrusion, the first protrusion of the other frame being received in the space.

3. The container of claim 1 wherein the protrusions are on a shoulder defined in the frame below a rim of the frame, the protrusions extending beyond the rim of the frame.

4. The container of claim 1 wherein each frame includes an anchoring lug, and the holding means comprises a spring clip engaging the anchoring lugs.

5. A container for storing and displaying merchandise comprising:

a first frame and a second frame, each frame defining an internal ledge;

a shell received by each frame, each shell having an outwardly extending peripheral flange secured to the ledge; and means for holding the frames together.

6. The container of claim 5 wherein the frames and the shells are plastic, and the shells are secured to the frames by sonic welding.

7. The container of claim 6 wherein in retaining lugs are defined on the frame above the ledge, said lugs extending over the peripheral flange on the shell to aid in retaining the shell in place.

8. A method of producing a container comprising:

forming a pair of identical frames having spaced protrusions;

securing a shell in each of said frames;

inverting one of said frames with respect to the other of said frames, and bringing the frames together so that at least one protrusion of each frame is received within the spaces on the other frame; and attaching to the frames adjacent to the protrusions means for holding the frames together.

9. The method of claim 8, further comprising:

forming a variety of shells having different depths, colors, and surface treatments; and selecting one of said shells for securing each of said frames.

10. The method of claim 8, wherein the step of securing further comprises sonic welding a shell in each of said frames.

* * * * *